United States Patent [19]

Kovaleski

[11] 4,140,289

[45] Feb. 20, 1979

[54] DISPOSABLE, WIRE STORAGE AND PAY-OUT SPOOL

[75] Inventor: Joseph J. Kovaleski, Easton, Conn.

[73] Assignee: Wyrepak Industries, Inc., Bridgeport, Conn.

[21] Appl. No.: 855,279

[22] Filed: Nov. 28, 1977

[51] Int. Cl.[2] ..... B65H 75/14

[52] U.S. Cl. ..... 242/118.6; 242/77.4; 242/118.8

[58] Field of Search ..... 242/118.8, 118.4, 118.6, 242/118.61, 118.62, 118.7, 115, 77, 77.3, 77.4, 79

[56] References Cited

U.S. PATENT DOCUMENTS

| | | | |
|---|---|---|---|
| 1,591,771 | 7/1926 | Batchelor | 242/115 |
| 1,815,499 | 7/1931 | Decombe | 242/118.61 X |
| 1,819,337 | 8/1931 | Pevear | 242/77.3 |
| 2,484,090 | 11/1949 | Hedfield | 242/118.8 X |
| 3,176,932 | 4/1965 | Kovaleski | 242/118.8 |
| 3,778,000 | 12/1973 | Breuner et al. | 242/79 |

FOREIGN PATENT DOCUMENTS

| | | | |
|---|---|---|---|
| 70219 | 8/1893 | Fed. Rep. of Germany | 242/118.61 |

*Primary Examiner*—George F. Mautz
*Attorney, Agent, or Firm*—H. Gibner Lehmann; K. Gibner Lehmann

[57] ABSTRACT

A low-cost, heavy-duty spool construction for holding substantial quantities of wire, comprising a generally cylindrical spool body having open ends, in combination with a pair of substantially identical, conical end flanges provided with annular grooves in their convex surfaces, in which grooves the end edges of the spool body are received. The apex portions of the end flanges have planar sections which are apertured, and a tie bar extends through the apertures to hold the end flanges tightly against the respective ends of the body. The arrangement is such that the end flanges can be assembled to the body with a minimum of time and effort, and with virtually no chance of an incorrect positioning of the relative parts of the device occurring. Following such assembly, the planar sections of the end flanges are maintained under continual tension, with the spool body being held in constant compression, thereby resulting in an especially rugged construction which is capable of withstanding rough handling even over extended periods of use.

14 Claims, 4 Drawing Figures

DISPOSABLE, WIRE STORAGE AND PAY-OUT SPOOL

BACKGROUND

This invention relates generally to spools which have conical ends and are adapted to carry appreciable, heavy quantities of wire; more particularly it relates to low-cost spools of the type that can be readily assembled for use and thereafter disassembled if desired, to facilitate their shipping and storage.

In the past a number of different spool constructions for holding large, heavy quantities of wire have been proposed and produced. Most prior spools consisted of a number of sheet-metal sections which were assembled to one another by welding. Generally, the cost of producing such spools was excessive, due to the relatively heavy gauge metal which was required, in addition to the cost of labor involved with the various welding procedures.

Various spool constructions of the take-apart variety have also been developed over the years. U.S. Pat. No. 2,295,222 discloses one such spool, having a central body portion and single conical end flange releasably secured thereto. The bore of the body portion is threaded, and a corresponding threaded portion on the end flange is received therein. While this construction was considered satisfactory under certain circumstances, it can be appreciated that the costs involved with providing mating thread formations on multiple sheet-metal parts tended to be rather high, resulting in a product which was prohibitively expensive for many applications or installations.

Another prior spool construction is illustrated in U.S. Pat. No. 1,786,366. The device disclosed therein involves a pair of disk-like end flanges which are fitted to a central spool body that is constituted as an iron pipe. Annular bead formations on one side of each flange are employed for keying the flanges to the body. Multiple bolts are utilized, located off-center with respect to the axis of the spool for securing the flanges together.

While this other patented device operated in a generally satisfactory manner, there were still a number of disadvantages inherent in the construction. First, it has been found to be quite difficult to assemble the end flanges to the spool body, since there is a tendency for the parts to shift with respect to one another as the bolts are being installed. Second, due to the small radius of curvature of the beads on the end flanges, there is encountered difficulty in effecting a proper seating thereof. Moreover, further difficulty is experienced in determining the proper torque to be applied to the nuts, in order to achieve a balanced or uniform pressure about the spool periphery. In addition, over-tightening of one or more of the nuts results in deformation of either or both of the end flanges, causing them to weaken and assume a somewhat concave shape. Accordingly, in the above respects the disclosed patented constructions did not prove to be satisfactory from the standpoint or either strength or low manufacturing cost.

Yet another take-apart spool is disclosed in U.S. Pat. No. 1,987,990. Here again, one of the disadvantages found is that multiple parts are involved, having unusual configurations, such as internal stop shoulders and the like, requiring special metal stampings which are costly to produce.

SUMMARY

The above disadvantages and drawbacks of prior spool constructions are obviated by the present invention, which has for an object the provision of a novel and improved spool for holding and dispensing large and heavy quantities of wire, which is both simple in construction and reliable in operation, as well as being capable of easy assembly all without the need for specialized equipment, fixtures, or tools.

Yet another object of the invention is the provision of an improved spool construction as above, which is light in weight while at the same time being especially rugged, and immune to damage or breakage from rough handling.

Still another object of the invention is the provision of an improved spool in accordance with the foregoing, wherein the overall cost of manufacture and assembly is low to enable the spool to be discarded, if desired, after its useful function has been fulfilled.

A still further object of the invention is the provision of an improved spool as above characterized, wherein the individual parts making up the assemblage can be readily replaced in the event that any one of them becomes damaged or deformed under conditions of unusual or extreme service.

An additional object of the invention is to provide an improved spool construction as above set forth, which is capable of being readily adapted to accommodate increased quantities of wire merely by substitution of a single part making up the spool.

The above objects are accomplished by the provision of a low-cost, heavy-duty spool construction for holding and dispensing substantial quantities of metal wire, comprising a generally cylindrical spool body having open ends, and a pair of substantially identical conical end flanges having annular grooves in their lateral surfaces, in which the end edges of the spool body are received. The apex portions of the end flanges have planar sections which are apertured, and a tie bar extends through the apertures to hold the end flanges tightly against the respective ends of the body. The arrangement is such that the end flanges can be assembled to the body with a minimum of time and effort, and later disassembled, if desired, in order to facilitate shipping and storage of the spool. In use, the conical walls at the apex portions of the end flanges are maintained under continual tension, with the spool body being held in constant compression, thereby resulting in an especially rugged construction capable of withstanding rough handling, even over extended periods of use.

Since the end flanges can be substantially identical to one another, there results a reduced overall manufacturing cost. In addition, the cylindrical body can be constituted of metal, or pressed resin-impregnated cardboard which is quite inexpensive but which has excellent strength and rigidity, sufficient to provide adequate support for the substantial weights being carried. Should either of the end flanges become damaged, or alternately if the body should become damaged, these can be readily replaced merely by loosening one nut, disassembling the spool, and replacing the desired part. Accordingly, great flexibility is realized. In addition, should it be desired to expand the capacity of the spool, it is only necessary to remove the end flanges and substitute a cylindrical body of increased length. The provision of a single tie bar or bolt disposed at the axis of the spool greatly facilitates such a substitution. This simple replacement of parts is usually not realizeable in the spools of the prior art.

With the present construction, spools adapted for continuous or repeated use can be made of added thickness or gauge, if desired, so as to withstand the stresses imposed by prolonged handling over extended periods of time.

Due to the fact that the annular grooves in the end flanges provide positive, well-defined seats for the opposite ends of the spool body, there exists no uncertainty as to the proper positioning of these flanges during assembly. In addition, such assembly can be greatly simplified by making the bore of the body slightly undersize, to enable the end flanges to be momentarily held therein by means of a force fit, as the tie bar is installed. Accordingly, no special tools or fixtures are required.

Other features and advantages will hereinafter appear.

In the drawings, illustrating a preferred embodiment of the invention:

Figure 1:
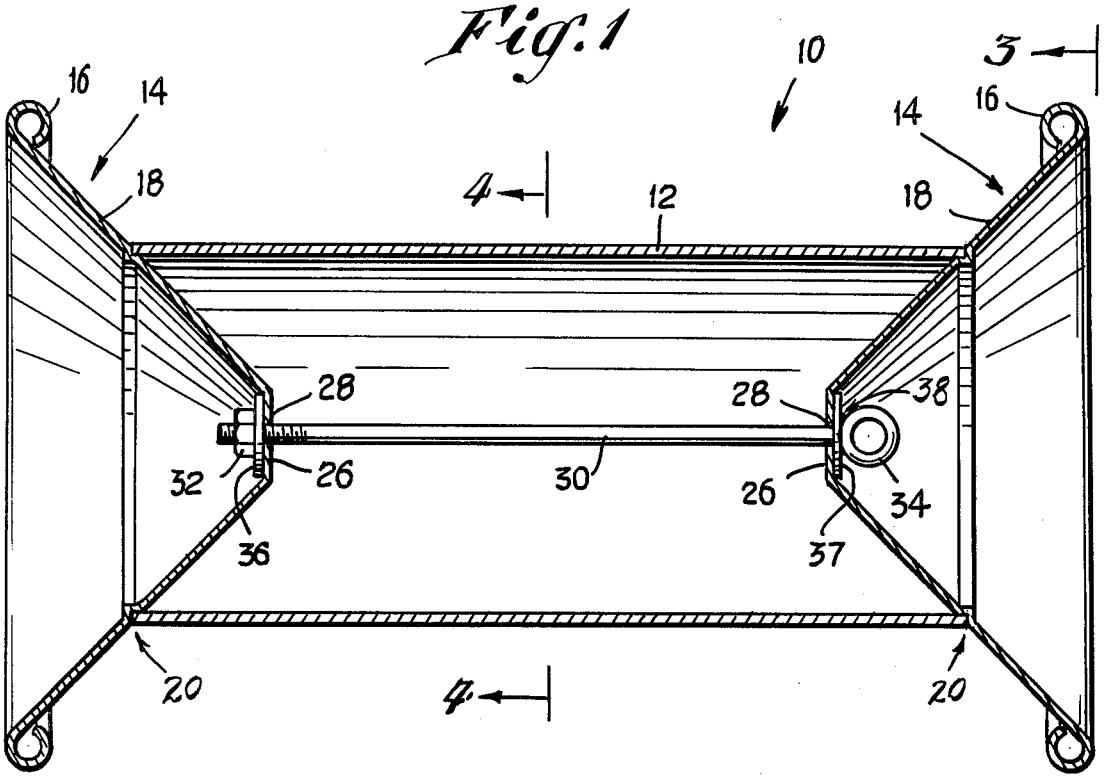
FIG. 1 is a vertical section of the improved spool construction of the present invention, showing a pair of conical end flanges secured to a central, substantially cylindrical spool body.
Figure 2:
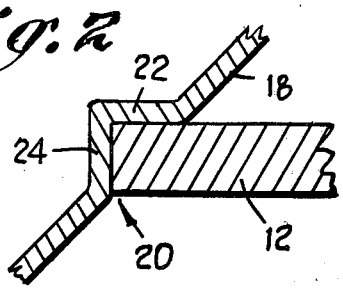
FIG. 2 is an enlarged, fragmentary view of one of the end flanges in the vicinity of the annular groove therein, showing a portion of the end of the spool body fitted thereto.
Figure 3:
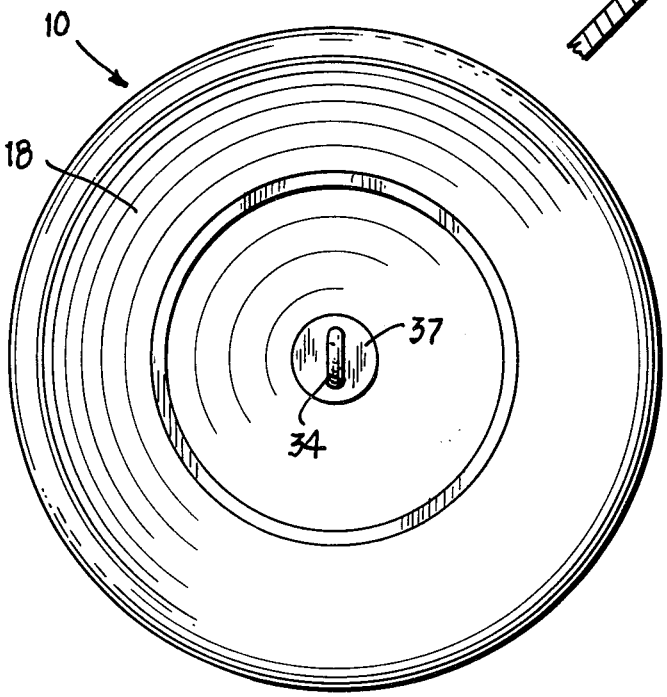
FIG. 3 is a view taken on line 3—3 of FIG. 1.
Figure 4:
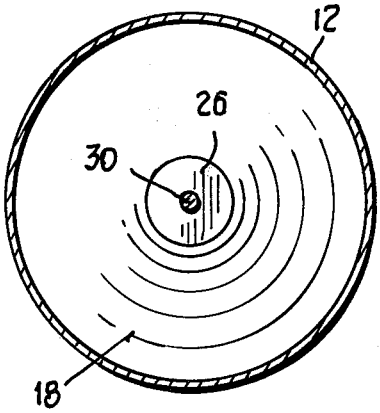
FIG. 4 is a section taken on line 4—4 of FIG. 1.

Referring first to FIG. 1 and in accordance with the present invention there is provided a novel and improved spool construction for holding large quantities of wire, designated generally by the numeral 10 and comprising a cylindrical spool body 12 having open ends, and a pair of substantially conical, metal end flanges 14. The end flanges 14 have curled-over rims 16 at their large diameter edge portions, which provide added stiffness. Disposed in the lateral or convex surfaces 18 of the end flanges 14 are annular grooves, one of which is particularly illustrated in FIG. 2. The grooves are generally designated by the numeral 20, and each comprises a first annular wall 22 and a second annular wall 24, which latter is substantially perpendicular to the first wall at all points around the periphery of the respective groove. The grooves 20 of the end flanges provide well-defined seats in which the ends of the spool body 12 are received. In FIG. 2 it can be seen that the width of the wall 24 is commensurate with the thickness of the wall of the body 12.

Referring again to FIG. 1 it can be seen that the apex of each end flange terminates in a planar section or surface disposed at right angles to the spool axis, the section or surface being designated generally by the numeral 26 and having an aperture 28 centrally disposed with respect thereto. Passing through the aperture is a tie bar 30 constituting draft means for securing the end flanges to one another. A nut 32 is carried on one end of the tie bar 30. Disposed at the other end of the bar is an eye 34, adapted to receive a suitable hook (not shown) when it is desired to transport or lift the spool.

Further, in accordance with the present invention, there is provided a washer disposed against the left hand planar section 28 in FIG. 1, such washer being designated by the numeral 36, and being adapted to distribute forces imparted thereto by the tie bar 30 over the entire apex portion 26 of the adjacent end flange 14 when the spool is assembled as shown. The washer 36 is of sufficient thickness so that little or no transverse flexing or bending thereof occurs. Accordingly, with such force distribution there is minimized any inward bending movement of the planar surface 26, thereby reducing the likelihood of permanent deformation thereof as the nut 32 is tightened.

Also carried by the tie bar 30 and located in the vicinity of the eye 34 is an additional washer 37 constituting a bearing piece. The latter is permanently secured to the eye by welding 38, and operates in a similar manner to distribute the force of the tie bar 30 over the entire adjacent planar surface 26, to thereby minimize any inward flexing or bending thereof as the nut 32 is tightened.

The above configuration is seen to have a number of distinct advantages over prior spool constructions. First, the assembly is greatly simplified by virtue of the fact that a positive seating of the spool body is achieved in the annular grooves 20 of the end flanges 14. In practice, the grooves 20 can be so sized that the bore of the body 12 is slightly smaller with respect to the radius defined by the wall 22. This can constitute an important feature since during assembly, each end flange 14 can be press fitted to the body 12 and momentarily held in place as the bolt 30, nut 32 and washer 36 are installed. Accordingly, no special holding or positioning fixtures are involved. Moreover, the assembly can be readily accomplished by one person, using only simple tools.

In place of the nut 32 shown, a "Tinnerman" type fastener, or other push-on type fastener could be employed, with equally good results, as can be readily understood.

In practice, the body 12 is preferably constituted of resin-impregnated cardboard, which as is well known, can be made very strong. The dimensions of the cardboard cylinder which is employed can be readily varied to suit a particular application, merely by cutting the piece to proper length. Accordingly, in the event that it is desired to adapted any spool to a different or increased capacity, it is only necessary to specify new lengths for the body 12 and for the tie bar 30. The end flanges 14 can all be manufactured to a fixed dimension, and used with spool bodies having different lengths as noted above. This constitutes a great advantage in keeping the overall cost of large numbers of spools to an absolute minimum. Alternately, in order to provide an even higher capacity spool, the conical end flanges 14 can be manufactured to a larger dimension, with the annular walls 22, 24 lying along a circle of increased radius, in order to accommodate a larger diameter body 12. Thus a great flexibility can be realized with the present design.

The above construction has been found to be especially rugged, since the cardboard body is maintained under continual compression and the conical end flanges in the vicinity of their apex portions are maintained under continual tension. By virtue of the provision of the washers 36, 37, there is virtually eliminated any inward flexing movements or other distortions of the planar sections 26 of the end flanges 14. Accordingly, the nut 32 can be tightened without danger of deforming the sections 26. The gauge of the metal of which the end flanges is constituted can be tailored to suit the conditions of use to which the spool is subjected. While the use of a heavy gauge metal will increase the weight, the wear resistance will be improved;

this may be advantageous in the event that the spool is intended to be used over prolonged periods of time, as opposed to being used once or twice and discarded.

In the case that any of the parts 14 or 12 becomes damaged due to inadvertent rough handling or misuse, removal of the damaged part is readily effected by merely loosening the nut 32 and substituting a new part. This constitutes a distinct advantage over prior spools which were constituted of sections which were welded together, since once such a spool was damaged or became dented or disfigured, it was usually necessary to discard the entire unit.

The end flange 14 can be manufactured by a process known in the trade as spinning, involving a die and a roller. Following spinning of the end flanges 14, the grooves 20 are formed in mass production, by a suitable punch (not shown).

With the present construction, the proper orientation of the various parts making up the spool is made abundantly clear to the person assembling the unit. There is thus minimized the likelihood of operator-related error being introduced into the finished product. When the nut 32 has been tightened to the proper extent, significant resistance against further tightening will be encountered, thus indicating to the assembler that the proper torque has been attained. Since the forces experienced by the spool body 12 are substantially axial as opposed to being transverse, a more rugged construction is realized. Also, a large component of the forces experienced by the conical portions 18 of the end flanges, specifically the forces occurring near their apices, lies substantially along the surfaces thereof and is tensile in nature, this also giving rise to improved strength and reduced tendency for buckling (which might otherwise be the case if a compressive force were to be applied to portions of the end flanges, or alternately a force having a major component which was transverse to the lateral surfaces thereof).

By the provision of the eye disposed at one end of the tie bar, there is provided a convenient means of transporting the spool from one location to another. In this connection, it is noted that the tie bar is disposed along the center or axis of the spool. Since spools of this type are normally stored and used while setting on one end flange, the unique location of the eye greatly facilitates handling. Typically, spools of this type weigh hundreds of pounds when filled with wire. In the past, transporting such spools has been a problem, particularly where specialized equipment has not been available to provide the substantial lifting forces required. Accordingly, many of the problems normally associated with transporting such heavy spools are alleviated by this construction.

It has been found that the cost involved with producing and assembling the various parts of the spool is sufficiently small that it can be merely discarded following an initial use, rather than being stored and returned to its point of origin.

The unique configuration of the end flanges, combined with the capability of disassembling the parts, enables substantial numbers of spools to be stored within limited confines. The end flanges 14, being identical, can be easily nested with one another; it can be readily appreciated that a series of nested end flanges will take up a very small space. In a similar manner, the cylindrical body 12 is considerably smaller in its dimensions than the assembled spool with which it is used, thus making storage and shipping of the various parts considerably easier than would otherwise be the case were the spool not capable of being disassembled.

The device is thus seen to represent a distinct advance and improvement in the technology of wire spooling equipment.

Each and every one of the appended claims defines a distinct aspect of the invention separate from the others, and each claim is accordingly to be treated in this manner when the prior art devices are examined in any determination of novelty of validity.

Variations and modifications are possible without departing from the spirit of the invention.

What is claimed is:

1. A low-cost, heavy-duty spool construction for holding and dispensing a substantial quantity and weight of metal wire, comprising in combination:

(a) a cylindrical spool body having open ends, (b) a pair of metal, spool end-flanges having substantially conical, large-diameter wire-engaging portions, said end flanges being fitted against the ends of the spool body with the apex portions of the flanges disposed within the body, (c) said end flanges having annular seats at their conical surfaces, in which the ends of the spool body are received, (d) said end flanges having central apertures in their apex portions, and (e) draft means comprising solely one tie bar passing through the apertures of the end flanges, for forcibly holding the same tightly against the ends of the spool body, said tie bar extending along the axis of the body and holding the flanges centered in the spool body, (f) said tie bar being under continual tension and in consequence thereof said body being under continual axial compression, regardless of whether the spool is empty or carrying wire, (g) said annular seats being constituted of stretched metal portions of the end flanges, (h) said assemblage of end flanges, spool body and draft means providing a spool construction which is closed at both ends and devoid of any through openings along its axis.

2. A low-cost, heavy-duty spool construction as in claim 1, wherein:

(a) the apex portions of the end flanges have planar sections in which the apertures are located, (b) said planar sections being disposed in planes which extend generally at right angles to the axis of the spool body.

3. A low-cost, heavy-duty spool construction as in claim 1, wherein:

(a) the annular seats of the end flanges have walls disposed respectively at right angles to each other.

4. A low-cost, heavy-duty spool construction as in claim 1, wherein:

(a) a wall of each of said annular seats lies in a plane disposed generally at right angles to the axis of the spool body.

5. A low-cost, heavy-duty spool construction as in claim 3, wherein:

(a) a wall of each of said annular seats is disposed in a plane extending substantially at right angles to the axis of the conical end flange.

6. A low-cost, heavy-duty spool construction as in claim 1, wherein:

(a) the tie bar has an eye at one end, disposed in a hollow of the associated end flange and adapted to enable a filled spool construction to be lifted by a hook inserted in said eye.

7. A low-cost, heavy-duty spool construction as in claim 6, wherein:

(a) the tie bar is threaded and carries a nut to draw the end flanges toward each other and tightly against the spool body.

8. A low-cost, heavy-duty spool construction as in claim 6, wherein:

(a) the eye of the tie bar has a flat bearing piece permanently secured to it, for engagement with the apex portion of the associated end flange.

9. A low-cost, heavy-duty spool construction as in claim 1, wherein:

(a) the spool body is constituted of thick, rigidly strong cardboard.

10. A low-cost, heavy duty spool construction as in claim 1, wherein:

(a) the apex portions of the end flanges extend axially into the ends of the spool body a distance which is commensurate with the distance which the remainder of the end flanges extend externally of the spool body in axial directions.

11. A low-cost, heavy-duty spool construction as in claim 4, wherein:

(a) the spool body is constituted of thick, rigidly strong cardboard, (b) said wall of each of the annular seats has a width which is commensurate with the thickness of the cardboard of the spool body.

12. A low-cost, heavy-duty spool construction as in claim 11, wherein:

(a) the large-diameter edge portions of the end flanges are curled over in the directions of the apex portions thereof.

13. A low-cost, heavy-duty spool construction as in claim 9, wherein:

(a) a wall of each of said annular seats is substantially cylindrical, (b) the end portions of the cardboard spool body being press-fitted on said cylindrical walls of the seats.

14. A low-cost, heavy-duty spool construction as in claim 2, and further including:

(a) rigid washer members on the tie bar, engaged with the planar sections of the end flanges and distributing the draft forces over the same.

* * * * *